US007223717B2

(12) United States Patent
Omata et al.

(10) Patent No.: US 7,223,717 B2
(45) Date of Patent: May 29, 2007

(54) THERMAL TRANSFER IMAGE RECEIVING SHEET AND METHOD FOR MANUFACTURING THE SAME

(75) Inventors: Takenori Omata, Tokyo-to (JP); Taro Suzuki, Tokyo-to (JP); Katsuyuki Oshima, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 271 days.

(21) Appl. No.: 10/834,640

(22) Filed: Apr. 29, 2004

(65) Prior Publication Data

US 2005/0026779 A1 Feb. 3, 2005

(30) Foreign Application Priority Data

Apr. 30, 2003 (JP) ..... 2003-125373
May 23, 2003 (JP) ..... 2003-145940

(51) Int. Cl.
*B41M 5/035* (2006.01)
*B41M 5/385* (2006.01)

(52) U.S. Cl. ..... 503/227; 428/32.39

(58) Field of Classification Search .. 428/32.39–32.51; 503/227

See application file for complete search history.

(56) References Cited

U.S. PATENT DOCUMENTS 6,380,131 B2 * 4/2002 Griebel et al. ..... 503/227

* cited by examiner

*Primary Examiner*—B. Hamilton Hess
(74) *Attorney, Agent, or Firm*—Ladas & Parry LLP

(57) ABSTRACT

The present invention provides a thermal transfer image receiving sheet having a good productivity, capable of inexpensively obtaining an image with high density and high resolution. A dye receiving layer is provided on one surface side of a base material film, and a porous layer with hollow particles bonded by a binder resin provided on the other surface side, respectively. The porous layer is attached with a base material via an adhesive layer.

12 Claims, 4 Drawing Sheets

THERMAL TRANSFER IMAGE RECEIVING SHEET AND METHOD FOR MANUFACTURING THE SAME

BACKGROUND OF THE INVENTION

1. Field of the Invention

The present invention relates to a thermal transfer image receiving sheet to be used in a state superimposed with a thermal transfer sheet.

2. Description of the Related Art

As a method for forming an image utilizing the thermal transfer, a method for forming a full color image with a thermal transfer sheet having a sublimation dye as a recording material supported by the surface of a base material sheet made of a paper, a plastic film or the like and a thermal transfer image receiving sheet provided with a receiving layer of a sublimation dye on the surface of a paper or a plastic sheet superimposed, is known. According to the method, since the sublimation dye is used as the color material, the density gradation can be adjusted freely so that the original full color image can be expressed on the image receiving sheet. Since the image formed by the dye is extremely vivid and has the excellent transparency, the excellent reproductivity of an intermediate color or the gradation can be provided so that a high-quality image coming up to the silver salt photograph can be formed.

In order to form a high-quality printed image on an image receiving sheet at a high speed by a sublimation type thermal transfer method printer, a dye receiving layer containing a dye dyeing property resin (a resin having a property to be easily dyed by a dye) as the main component on the base material or the image receiving sheet. When a paper material such as a coat paper and an art paper is used as a the base material of the image receiving sheet, since the thermal conductivity of these materials is relatively high, the dye receiving sensitivity in the receiving layer becomes lower.

Then, as it is disclosed in Japanese Patent Application Laid Open (JP-A) No. 5-16539, a biaxial oriented foamed film having a gap inside, containing a thermoplastic resin such as a polyolefin as the main component can be used as the base material for the image receiving sheet. Since an image receiving sheet using such film as the base material has an even thickness, the flexibility and a smaller thermal conductivity compared with a paper made of a cellulose fiber or the like, it is advantageous in that an even image with a high density can be obtained. However, in the case a biaxial oriented film is used for the base material of the image receiving sheet, the residual stress at the time of drawing is alleviated by the heat at the time of printing so that the film is contracted in the drawing direction. As a result, curling and wrinkles are generated in the image receiving sheet so that a trouble such as paper jam or the like may be generated at the time of running the image receiving sheet in a printer.

In order to improve the disadvantage, as it is disclosed in JP-A No. 3-268998, there is an example of using a laminated sheet as the base material of the image receiving sheet, the laminated sheet is manufactured by attaching and laminating a biaxial oriented foamed film having a gap on a core material having a relatively small thermal contraction ratio or a core material having a large elastic modulus.

Moreover, there is also a thermal transfer image receiving sheet manufactured by superimposing a non foamed plastic film on a core material via an adhesive including a foaming agent and foaming the foaming agent in the state to make the adhesive layer be a porous structure (see JP-A No. 6-23040).

A technique of forming a porous layer having both the insulation property and the cushion property by coating a porous layer coating solution made of hollow particles mixed in a binder resin onto a base material sheet is known (see JP-A No. 2002-212890).

SUMMARY OF THE INVENTION

However, since the biaxial oriented film having a gap has a large stretching property, the tension control at the time of lamination is difficult, and furthermore, the cost is drastically raised. Moreover, in the case of forming the porous layer by coating the porous layer coating solution onto the paper base material, depending on the kind of the material of the paper base material or the binder resin, the moisture content of the coating solution permeates into the paper base material so as to generate the ruggedness on the porous layer surface after drying so that ,because of the influence, the ruggedness appears also on the surface of the dye receiving layer to generate the defect such as the density irregularity and the dot omission at the time of the image formation.

Accordingly, an object of the present invention is to provide a thermal transfer image receiving sheet or the like having a good productivity, capable of inexpensively obtaining an image with high density and high resolution by solving the problems of the conventional techniques, that is, the problems of the sensitivity deterioration in the case of using a pulp paper such as a coating paper as the supporting member, the conveyance property deterioration in the case of using a biaxial oriented film containing a gap, the productivity deterioration and the cost rise in the case of using a laminated sheet attached a foamed film and a core material, or the like.

Furthermore, an object thereof is to provide a thermal transfer image receiving sheet or the like capable of avoiding the various problems in terms of the productivity accompanied by the attachment of the foamed film by coating to form the porous layer, and capable of obtaining a high-quality image without the density irregularity or the dot omission without the risk of the permeation of the moisture content included in the porous layer coating solution into the paper base material.

Since the first thermal transfer image receiving sheet of the present invention comprises a dye receiving layer provided on one side surface of a base material film and a porous layer having hollow particles bonded by a binder resin on the other surface side, respectively, the porous layer being bonded with a paper base material via an adhesive layer, the above-mentioned problems can be solved.

According to the thermal transfer image receiving sheet, since the dye receiving layer is provided on one side surface of the base material film provided independently from the paper base material and the porous layer provided on the other surface side so that the moisture content cannot permeate into the base material film at the time of coating the porous layer or even when it permeates therein, the degree of the permeation is far less than the permeation with respect to the paper base material, the dye receiving layer can be formed with a high smoothness degree by restraining the ruggedness of the base material to form the porous layer. Moreover, since the porous layer provided on the base material film and the paper base materials are bonded via the adhesive layer, by attaching the paper base material after drying the coating solution of the porous layer, the smoothness degree of the dye receiving layer can be maintained at a high level by preventing the appearance of the ruggedness regardless of the kind of the paper base material without the risk of the permeation of the moisture content into the paper base material. Thereby, a high-quality image can be obtained without the density irregularity or the dot omission at the time of the image formation.

According to the first thermal transfer image receiving sheet, the order of forming the dye receiving layer and the porous layer with respect to the base material film is not particularly limited. The dye receiving layer may be laminated directly on the one surface side of the base material film without another layer or an intermediate layer may be provided between the base material film and the dye receiving layer.

According to the first thermal transfer image receiving sheet, the binder resin may be a water soluble resin. Since the water soluble resin has a high viscosity and a high water retention property, even when the base material film has the nature of absorbing the moisture content, permeation of the moisture content with respect to the base material film can be restrained. In this case, as the binder resin, a commonly used water based resin such as a polyester, a polyurethane, a polyvinyl alcohol and an acrylic can be used.

Furthermore, the binder resin may be a polyvinyl alcohol resin having a 1,000 or more average polymerization degree. Since such a resin has a strong bonding force with respect to the hollow particles so that a sufficient bonding force can be obtained so as to prevent peel off of the porous layer from the base material film even when the hollow particles are added by 90% by weight, a high-quality thermal transfer image receiving sheet having a high sensitivity without the dot omission can be provided.

According to the first thermal transfer image receiving sheet, it is preferable that the thickness of the base material film is 20 μm or less. If the thickness of the base material film is more than 20 μm, the influence of the physical properties of the base material film cannot be ignorable compared with the influence of the cushion property and the insulation property of the porous layer so that the density irregularity or the like can be generated at the time of the image formation, derived form the unevenness of the base material film.

Moreover, the content ratio of the hollow particles in the porous layer is preferably in a range of 70% by weight to 90% by weight. When it is less than 70% by weight, sufficient insulation property and cushion property may not be obtained, and if it is more than 90% by weight, insufficiency of the bonding force may generate the peel off of the porous layer from the base material film. Furthermore, it is preferable that the thickness of the porous layer is in a range of 5 μm to 40 μm. When it is less than 5 μm, sufficient insulation property and cushion property may not be obtained. On the other hand, if it is more than 40 μm, the insulation property becomes saturated so as to be wasteful in terms of the cost. Furthermore, the adhesive layer may be a resin extruded by an extruding machine.

Since the first method for manufacturing a thermal transfer image receiving sheet of the present invention comprises the processes of forming a dye receiving layer on one surface side of a base material film and a porous layer by bonding hollow particles to a binder resin on the other surface side, respectively, and attaching the porous layer on a paper base material via an adhesive layer after drying the porous layer, the above-mentioned problems can be solved.

According to the manufacture method, the above-mentioned effects can be achieved by providing the above-mentioned first thermal transfer image receiving sheet of the present invention.

According to the first method for manufacturing a thermal transfer image receiving sheet of the present invention, the porous layer and the paper base material may be attached via an extruded resin. As the binder resin, a water soluble resin can be used. Moreover, as the binder resin, a polyvinyl alcohol resin having a 1,000 or more average polymerization degree may be used. It is preferable that the thickness of the base material film is 20 μm or less. It is preferable that the content ratio of the hollow particles in the porous layer is in a range of 70% by weight to 90% by weight. It is preferable that the thickness of the porous layer is in a range of 5 μm to 40 μm. The advantages of these embodiments are as they are explained in the preferable embodiments of the thermal transfer image receiving sheets.

The second thermal transfer image receiving sheet of the present invention comprises a dye receiving layer provided on a base material sheet via an insulation layer and a thin film, wherein the insulation layer is formed by providing a resin layer containing a foaming agent or a thermally expansible micro capsule on one side of the thin film, and contacting an extruded resin with the resin layer so as to foam or expand the resin layer at the time of EC laminating the resin layer side of the thin film and the base material sheet.

Moreover, the second method for manufacturing a thermal transfer image receiving sheet of the present invention, having a dye receiving layer provided on a base material sheet via an insulation layer and a thin film, is characterized by comprising the processes of providing a resin layer containing a foaming agent or a thermally expansible micro capsule on one side of the thin film, forming an insulation layer by contacting an extruded resin with the resin layer so as to foam or expand the resin layer at the time of EC laminating the resin layer side of the thin film and the base material sheet, and forming a receiving layer on the thin film surface side.

The third method for manufacturing a thermal transfer image receiving sheet having a dye receiving layer provided on a base material sheet via an insulation layer and a thin film, is characterized by comprising of forming a receiving layer on the thin film, providing a resin layer containing a foaming agent or a thermally expansible micro capsule on the opposite surface of the thin film, and forming an insulation layer by contacting an extruded resin with the resin layer so as to foam or expand the resin layer at the time of EC laminating the resin layer side of the thin film and the base material sheet.

The fourth method for manufacturing a thermal transfer image receiving sheet having a dye receiving layer provided on a base material sheet via an insulation layer and a thin film, is characterized by comprising the processes of providing a resin layer containing a foaming agent or a thermally expansible micro capsule on one side of the thin film, forming an insulation layer by applying a heat treatment to the resin layer by an oven or a heat roller, EC laminating the insulation layer side of the thin film and the base material sheet, and forming a receiving layer on the thin film surface side.

The fifth method for manufacturing a thermal transfer image receiving sheet having a dye receiving layer provided on a base material sheet via an insulation layer and a thin film, is characterized by comprising the processes of forming a receiving layer on the thin film, providing a resin layer containing a foaming agent or a thermally expansible micro capsule on the opposite surface of the thin film, forming an insulation layer by applying a heat treatment to the resin layer by an oven or a heat roller, and EC laminating the insulation layer side of the thin film and the base material sheet.

Moreover, according to the above-mentioned second to fifth methods for manufacturing a thermal transfer image receiving sheet, a die head may be moved to the thin film side at the time of EC laminating, or a laminate roll on the thin film side may be heated at the time of EC laminating.

Moreover, according to the above-mentioned second to fifth methods for manufacturing a thermal transfer image receiving sheet, a heat treatment may be applied by a heat roll after EC laminating.

According to the second and third methods for manufacturing a thermal transfer image receiving sheet of the present invention, having a dye receiving layer provided on a base material sheet via an insulation layer and a thin film, comprise the processes of providing a resin layer containing a foaming agent or a thermally expansible micro capsule on one side of the thin film, forming an insulation layer by contacting an extruded resin with the resin layer so as to foam or expand the resin layer at the time of EC laminating the resin layer side of the thin film and the base material sheet, and forming a receiving layer on the thin film surface side, or comprise the processes of forming a receiving layer on the thin film first, providing a resin layer containing a foaming agent or a thermally expansible micro capsule on the opposite surface of the thin film, and forming an insulation layer by contacting an extruded resin with the resin layer so as to foam or expand the resin layer at the time of EC laminating the resin layer side of the thin film and the base material sheet.

Moreover, according to the fourth and fifth methods for manufacturing a thermal transfer image receiving sheet of the present invention, having a dye receiving layer provided on a base material sheet via an insulation layer and a thin film, comprise the processes of providing a resin layer containing a foaming agent or a thermally expansible micro capsule on one side of the thin film, forming an insulation layer by applying a heat treatment to the resin layer by an oven or a heat roller, EC laminating the insulation layer side of the thin film and the base material sheet, and forming a receiving layer on the thin film surface side, or comprise the processes of forming a receiving layer on the thin film, providing a resin layer containing a foaming agent or a thermally expansible micro capsule on the opposite surface of the thin film, forming an insulation layer by applying a heat treatment to the resin layer by an oven or a heat roller, and EC laminating the insulation layer side of the thin film and the base material sheet.

Accordingly, by foaming or expanding the resin layer containing a foaming agent or a thermally expansible micro capsule by contacting the same with an extruded resin at the time of EC laminating the resin layer side of the thin film and the base material sheet, or as needed, by applying a heat treatment to the resin layer by an oven or a heat roller before EC laminating, the insulation layer is formed. The insulation layer has a high cushion property and an insulation property. Thereby, a laminated and attached sheet of a foamed film and a core material can be manufactured inexpensively and efficiently so that a high performance thermal transfer image receiving sheet, capable of obtaining an image with a high density and a high resolution can be obtained without the density irregularity or the dot omission.

DESCRIPTION OF THE PREFERRED EMBODIMENTS (First Embodiment)

Figure 1B:
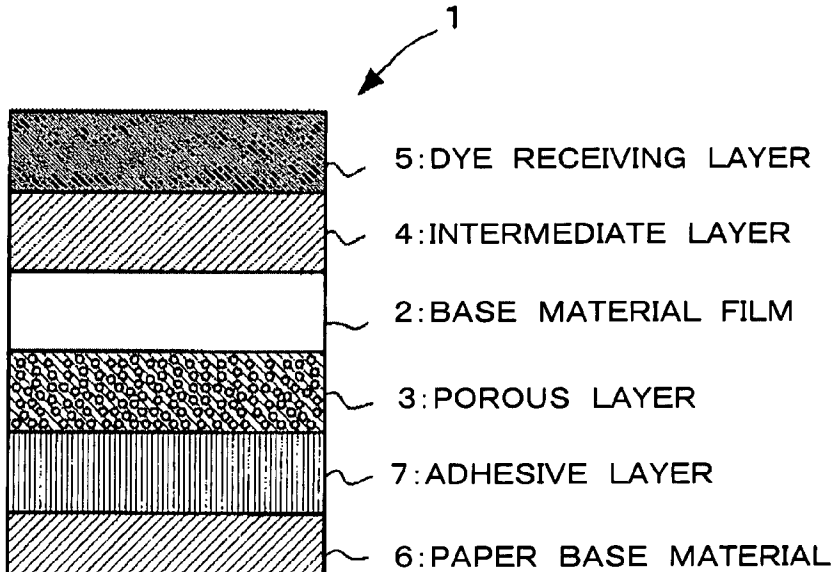
FIG. 1B is a schematic cross sectional view of the thermal transfer image receiving sheet.
Figure 1A:
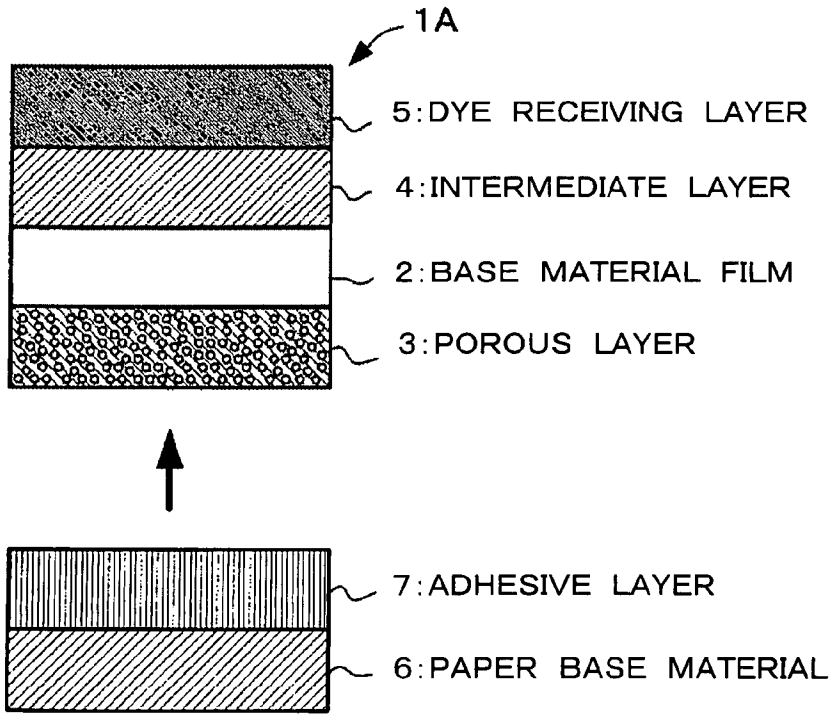
FIG. 1A is a schematic cross sectional view of an example of the first embodiment according to a thermal transfer image receiving sheet of the present invention in a state of the halfway of the formation.

FIG. 1B shows the cross sectional structure of a thermal transfer image receiving sheet 1 according to an embodiment of the present invention, and FIG. 1A shows the state of the halfway of the formation of the thermal transfer image receiving sheet 1. In FIGS. 1A and 1B, the layers are described in a constant thickness for the convenience regardless of the actual thicknesses in the thermal transfer image receiving sheet. As shown in FIG. 1A, the thermal transfer image receiving sheet 1 is manufactured by forming a porous layer 3 on the lower surface side of a base material film 2 and an intermediate layer 4 and a dye receiving layer 5 on the upper surface side successively so as to provide a laminated member 1A, and attaching a paper base material 6 on the lower surface of the porous layer 3 of the laminated member 1A via an adhesive layer 7.

It is preferable that the base material film 2 does not absorb the moisture content or barely absorb the same at the time of coating the porous layer 3, and a plastic film can be used preferably. As the plastic film to be used here, for example, films made of various resins such as a PET film, a polyethylene and a polypropylene can be used. In order to restrain the influence of the physical properties of the base material film 2 on the dye receiving layer 5, a thinner base material film 2 is preferable. It is preferable that the thickness of the base material film 2 is limited to 20 μm or less.

The porous layer 3 is formed by bonding hollow particles to binder resin. Specifically, the porous layer 3 is formed by coating a coating solution, which is obtained by dissolving and dispersing the binder resin and the hollow particles in a solvent, onto the lower surface side of the base material film 2, and drying the coating solution. As the hollow particles to be used for the porous layer 3, either foamed particles or non foamed particles can be used. For example, organic hollow particles such as a cross linked styrene-acrylic, inorganic hollow glass members or the like can be sued as the hollow particles. In the case of using the foamed particles, they may be either of closed cells or open cells. The void ratio of the hollow particles is preferably 50% or more. In the case the void ratio is less than 50%, sufficient insulation property and cushion property may not be provided to the porous layer 3. Moreover, the content ratio of the hollow particles in the porous layer 3 is preferably in a range of 70% by weight to 90% by weight, and the thickness of the porous layer 3 is preferably in a range of 5 μm to 40 μm. The reasons therefore are as mentioned above.

As the binder resin for bonding the hollow particles, a resin resistant to an organic solvent is preferable. In particular, since a water soluble resin such as a polyvinyl alcohol, a soda polyacrylate, and a carboxy methyl cellulose has a high viscosity and excellent water retention property, it is preferable in terms of preventing permeation of moisture content into the base material film 2. Moreover, among the water soluble resins, in particular, a polyvinyl alcohol having a high molecular weight is preferable for the strong bonding force with respect to the hollow particles and the high water retention property. A polyvinyl alcohol resin having a 1,000 or more average polymerization degree is further preferable.

The operation for coating the porous layer 3 can be executed by a common method such as gravure coating, gravure reverse coating, comma coating, dye coating and lip coating.

The intermediate layer 4 denotes all the layers existing between the base material film 2 and the dye receiving layer 5. The intermediate layer 4 may have either a single layer structure or a plural layer structure. The intermediate layer 4 can be provided as needed, and it may be omitted as well.

In order to provide the blocking property or the whiteness property, or adjust the feeling of the entire thermal transfer image receiving sheet 1, the intermediate layer 4 may include an inorganic pigment such as a calcium carbonate, a talc, a kaolin, a titanium oxide, zinc oxide and the other known inorganic pigment or fluorescent brightening agent. The composition ratio is preferably 10 to 200 parts by weight with respect to 100 parts by weight of the resin solid component. If it is less than 10 parts by weight, the effect cannot be provided sufficiently, and if it is more than 200 parts by weight, the resin performance may not be obtained due to the lack of the dispersion stability.

The dye receiving layer 5 is provided by adding as needed various kinds of additives such as a mold releasing agent to a varnish containing a resin to be dyed easily by a dye as the main component. As the resin to be dyed easily by a dye, a single material of a polyolefin resin such as a polypropylene, a polyvinyl chloride resin, a halide resin such as a polyvinylidene chloride, a vinyl based resin such as a polyvinyl acetate and a polyacrylate, and a copolymer thereof; a polyester resin such as a polyethylene terephthalate and a polybutylene terephthalate, a polystyrene based resin, a polyamide based resin, a copolymer of an olefin such as an ethylene and a propylene and another vinyl based monomer, a single material of an ionomer and a cellulose derivative, and a mixture thereof can be used. Among these examples, a polyester based resin and a vinyl based resin are preferable.

A mold releasing agent may be included in the dye receiving layer 5, for preventing the thermal fusion with the thermal transfer sheet at the time of the image formation. As the mold releasing agent, a silicone oil, and a phosphate ester based plasticizing agent fluorine based compound can be used. A silicone oil can be used particularly preferably. As the silicone oil, a modified silicone such as an epoxy modified one, an alkyl modified one, an amino modified one, a fluorine modified one, a phenyl modified one and an epoxy polyether modified one can be used preferable. In particular, a reaction product of a vinyl modified silicone oil and a hydrogen modified silicone oil is preferable. The addition amount of the mold releasing agent is preferably 0.2 to 30 parts by weight with respect to the resin for providing the dye receiving layer 5.

The dye receiving layer 5 can be formed by a common coating method such as roll coating, bar coating, gravure coating and gravure reverse coating. The coating amount of the dye receiving layer 5 is preferably 0.5 to 10 g/m$^2$.

The paper base material 6 is used for providing texture feeling and rigid feeling comparable to the silver salt photograph to the entire thermal transfer image receiving sheet 1. As the paper base material 6, for example, a wood free paper or an art paper having a basis weight of 78 to 400 g/m$^2$, preferably of 150 to 300 g/m$^2$ can be used. The thickness of the paper base material 6 is preferably in a range of 40 to 300 μm, and further preferably it is set in a range of 60 to 200 μm. In order to provide the texture feeling equivalent to that of the printing paper of the silver salt photograph to the thermal transfer image receiving sheet 1, the thickness of the entire thermal transfer image receiving sheet 1 can be set in a range of 150 to 250 μm.

As the adhesive layer 7, the kind there of is not particularly limited as long as it can bond the paper base material 6 and the porous layer 3. Typically, an urethane based adhesive resin, a polyolefin based one, a polyester based one, an acrylic based one or an epoxy based one can be used. Moreover, as the method for bonding the porous layer 3 and the paper base material 6, the porous layer 3 and the paper base material 6 can be attached while forming the adhesive layer 7 using the so-called EC laminating method of attaching the porous layer 3 and the paper base material 6 while extruding a resin comprising the adhesive layer with the extruded resin interposed therebetween. As the extruded resin used of the EC laminating method, a commonly used polyolefin based resin can be presented.

Figure 2:
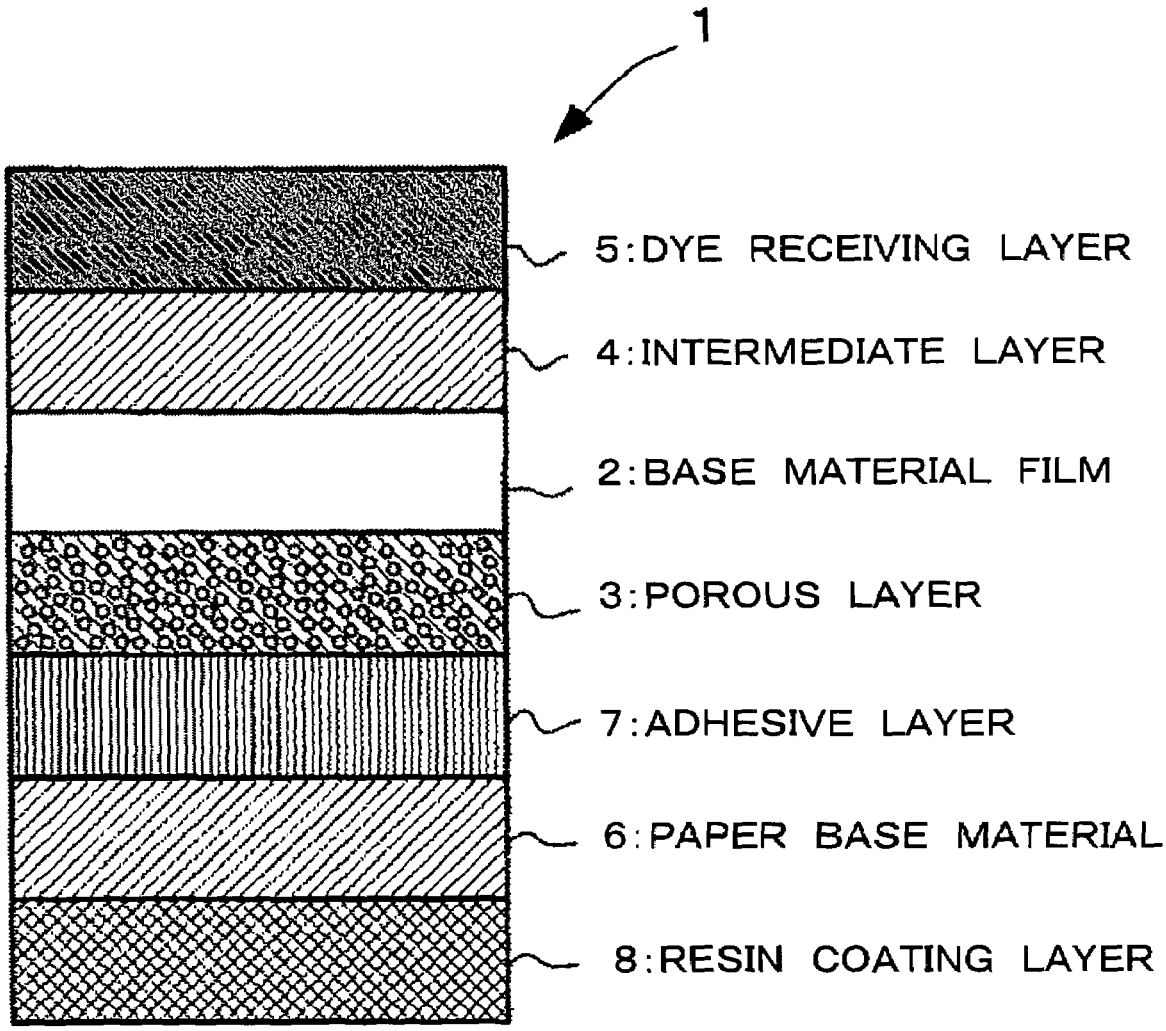
FIG. 2 is a schematic cross sectional view showing another example according to the first embodiment of a thermal transfer image receiving sheet of the present invention.

As shown in FIG. 2, by providing the resin coating layer 8 to the lower surface of the paper base material 6, the moisture retention property for preventing curling of the paper base material 6, or the smoothness for reducing the friction resistance at the time of having the thermal transfer image receiving sheet 1 being conveyed by a printer may be provided. In order to achieve the purpose of providing the moisture retention property, a resin having a wheel control switch effect, such as a polyvinyl alcohol and a polyethylene glycol can be used as the material for the resin coating layer 8. Moreover, in order to provide the smoothness, a resin with an organic or inorganic filler dispersed can be used as the material for the resin coating layer 8. Furthermore, a lubricating agent such as a silicone or a mold releasing agent may be added to the resin coating layer 8.

(Second Embodiment)

Figure 3:
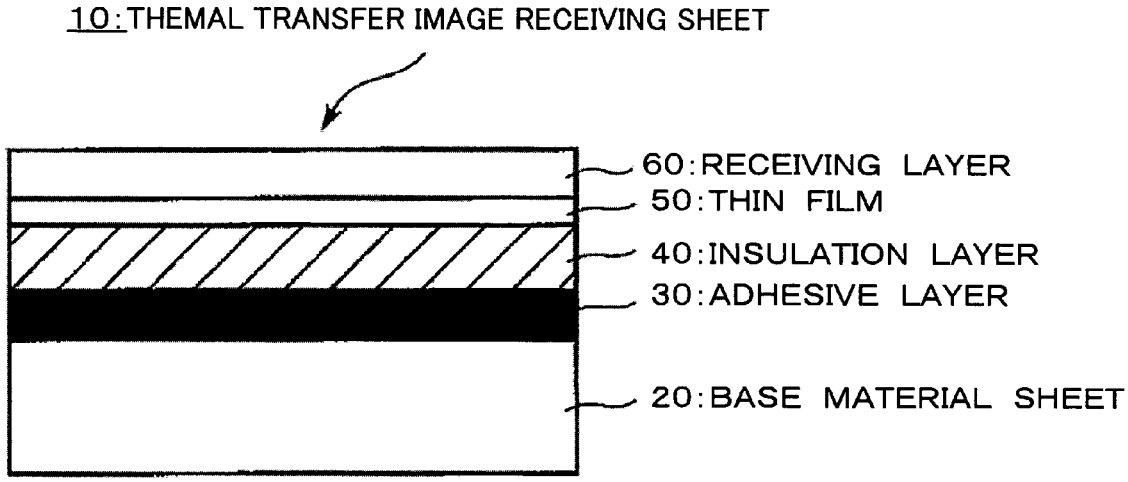
FIG. 3 is a schematic cross sectional view showing an example of the second embodiment of a thermal transfer image receiving sheet of the present invention.

Hereinafter, the second embodiment of the present invention will be explained. FIG. 3 is a schematic cross sectional view showing an example of a thermal transfer image receiving sheet of a second embodiment of the present invention.

It is a thermal transfer image receiving sheet 10 having an adhesive layer 30, an insulation layer 40, a thin film 50 and a receiving layer 60 laminated successively on a base material sheet 20. The insulation layer 40 is formed by providing a resin layer containing a foaming agent or a thermally expansible micro capsule to the thin film 50, and foaming or expanding the resin layer by contacting the resin layer with an extruded resin at the time of EC laminating the resin layer side of the thin film 50 and the base material sheet 20. The layer formed by the extruded resin to be EC laminated is the adhesive layer 3.

The thermal transfer image receiving sheet of the present invention is not limited to the embodiment shown in FIG. 3, and a layer can be added as needed, such as a rear surface layer provided on the other side surface of the base material sheet, and an intermediate layer provided between the adjacent layers shown in FIG. 3.

(Base Material Sheet)

Since the base material sheet 20 plays the role of supporting the insulation layer, the receiving layer or the like, and a heat is applied thereto at the time of the thermal transfer, it preferably has a mechanical strength to the degree not to have a problem in handling in the heated state. As the material for the base material sheet, for example, a condenser paper, a grassine paper, a parchment paper, a paper with a high size degree, a synthetic paper (polyolefin based, polystyrene based), a wood free paper, an art paper, a coat paper, a cast coat paper, a wall paper, a backing paper, a synthetic resin or emulsion impregnated paper, a synthetic rubber latex impregnated paper, a synthetic resin inner added paper, a board paper, a cellulose fiber paper, or films of a polyester, polyacrylate, a polycarbonate, a polyurethane, a polyimide, a polyether imide, a cellulose derivative, a polyethylene, an ethylene vinyl acetate copolymer, a polypropylene, a polystyrene, an acrylic, a polyvinyl chloride, a polyvinylidene chloride, a polyvinyl alcohol, a polyvinyl butylal, a nylon, a polyester ether ketone, a polysulfone, a polyether sulfone, a tetrafluoro ethylene.perfluoro alkyl vinyl ether, a polyvinyl fluoride, a tetrafluoro ethylene.ethylene, a tetrafluoro ethylene.hexafluoro propylene a polychloro trifluoro ethylene, a polyvinylidene fluoride or the like, can be presented. Moreover, a white opaque film manufactured by adding a white pigment or a filling agent to these synthetic resins and forming a film, or a foamed sheet manufactured by foaming can be used as well.

According to the present invention, among the above-mentioned base material sheets, in particular, use of the pulp papers such as a wood free paper, an art paper, a coat paper, and a cast coat paper is preferable for the cost reduction or the like.

A laminated member comprising an optional combination of the above-mentioned base material sheets can be used as well.

The thickness of the base material sheet to be used in the present invention can be set optionally, and it is in general about 10 to 300 μm. Moreover, in the case the adhesion property between the above-mentioned base material sheet and a layer provided thereon is poor, it is preferable to apply various kinds of the primer process or the corona electric discharge process to the surface of the base material sheet.

(Adhesive Layer)

The adhesive layer 30 to be formed from an extruded resin by the EC lamination can be made of the resins described below. It is preferable to use polyolefin resins such as a high density polyethylene, a middle density polyethylene, a low density polyethylene, a polypropylene, and an ethylene.vinyl acetate copolymer; polyester resins such as a polyethylene.terephthalate; ionomer resins; a nylon; and a resin having a relatively small neck in (the phenomenon or the degree of having the film width narrower than the dye width) and a relatively good draw down property (it is the criterion of the high speed spreading property and the high speed processing property) such as a polystyrene, a polyurethane or the like. The resins can be used alone or as a mixture of a plurality of kinds.

The thickness of the adhesive layer can be changed optionally, and it is in general about 1 to 50 g/m$^2$ (solid component).

(Insulation Layer)

The insulation layer 40 used in the present invention is manufactured providing a resin layer containing a foaming agent or a thermally expansible micro capsule on a thin film, and contacting the resin layer with an extruded resin at the time of EC laminating the resin layer side of the thin film and the base material film so as to foam or expand the resin layer for forming the insulation layer 40.

The insulation layer contains the foaming agent or the thermally expansible micro capsule, and the binder resin as the main components.

As the foaming substance, a chemical foaming agent, a thermally expansible micro capsule or the like can be used. As the chemical foaming agent, for example, organic foaming agents including an azo compound such as an azo dicarbon amide, and an azo bis isobutylonitrile, anitroso compound such as a dinitroso pentamethylene tetramine, a sulfonyl hydronizide compound such as a p-toluene sulfonyl hydrazide, and a p,p'-oxy bis (benzene sulfonyl hydrazide), a β-keto acid such as an oxalacetic acid and a malonic acid, a tartonic acid, and an acetone dicarboxylic acid, and inorganic foaming agents including a sodium bicarbonate, an ammonium bicarbonate, and an ammonium carbonate can be presented. They can be used with the foaming temperature and the foaming amount adjusted by adding a foaming auxiliary agent thereto.

As the thermally expansible micro capsule, for example, there are those utilizing a thermoplastic resin containing a low boiling point hydrocarbon such as an n-butane, an i-butane, a pentane, and a neopentane, mainly containing an acrylic ester such as a vinylidene chloride, an acrylonitrile and a methyl methacrylate and an aromatic vinyl compound such as a styrene as the wall film material for the capsule. As the commercially available products, Matsumoto Microsphere F-30, F-50, F-80 (product names produces by Matsumoto Yushi-Seiyaku Co., Ltd.), Expancel WU-461, WU-551, WU-091, WU-51 (produced by Japan Ferrite Co., Ltd.) or the like can be presented.

Moreover, in the case of the thermally expansible micro capsule, those having about a 1 to 15 μm volume average particle size before foaming, and a 5 to 50 μm particle size after foaming are preferable.

Since those having a more than 15 μm volume average particle size before foaming or those having a more than 50 μm particle size after foaming make the insulation layer surface rugged and cast the adverse effect to the image quality of the formed image, they are not preferable.

As for the foaming agent or the thermally expansible micro capsule, it is preferable that a softening temperature or foaming starting temperature of the partition wall is 100° C. or less, and an optimum foaming temperature (the temperature at which the expansion ratio becomes highest in a 1 minute heating time) is 140° C. or less. By using a foaming substance having a low foaming temperature, the thermal wrinkling or curling of the base material at the time of foaming can be prevented. The thermally expansible micro capsule having a low foaming temperature can be obtained by adjusting the composition amount of the thermoplastic resin comprising the partition wall such as a polyvinylidene chloride and a polyacrylonitrile. The volume average particle size is 1 to 15 μm. The insulation layer using the micro capsule is advantageous for the closed cells as the bubbles obtained by foaming, capability of foaming by a simple process of only heating, easy control of the foaming layer thickness by the composition amount of the micro capsule or the like.

As the binder resin, a water soluble adhesive, a water based adhesive such as a latex based adhesive, a solvent based adhesive, and an adhesive of a monomer, an oligomer or a prepolymer having an ethylenically unsaturated bond to be hardened by an electron beam or an ultraviolet ray or the like can be used.

As the water soluble adhesive, water soluble natural polymer compounds such as proteins such as a gelatin, an albumine and a casein, starches, celluloses, an agar, a soda arginate and a gum Arabic, and soluble synthetic polymer compounds such as a polyvinyl alcohol, a polyvinyl pyrrolidone, a polyacrylic acid, a polyacrylic amide and a maleic acid copolymer can be presented.

As the latex based adhesive, a styrene.butadiene latex, an acrylonitrile.butadiene latex, an acrylicester based latex, a vinyl acetate based latex, a vinylidene chloride latex, a methyl methacrylate.butadiene based latex, and a carboxy modified latex thereof or the like can be presented.

As the solvent based adhesive, natural resins such as a rosin, a shellac, a copal, a darman, a gilsonite and a zein, cellulose derivative resins such as a hard rosin, an ester gum and another rosin ester, a maleic acid resin, a fumaric acid resin, a doubled rosin, a polymerized rosin, a rosin modified phenol resin, a methyl cellulose and an ethyl cellulose, and synthetic resins such as a phenol resin, a xylene resin, a urea resin, a melamine resin, a ketone resin, a chroman.indene resin, a petroleum resin, a terpene resin, a cyclic rubber, a chloride rubber, an alkyd resin, a polyamide resin, an acrylic resin, a polyvinyl chloride, a vinyl chloride.vinyl acetate copolymer, a polyvinyl acetate, an ethylene.maleic anhydride copolymer, a styrene.maleic anhydride copolymer, a methyl vinyl ether.maleic anhydride copolymer, an isobutylene.maleic anhydride copolymer, a polyvinyl alcohol, a modified polyvinyl alcohol, a butylal resin, an acetal resin, a polyvinyl pyrrolidone, a chlorinated polypropylene styrene resin, an epoxy resin, a polyurethane resin can be presented.

Moreover, as the monomer, oligomer or prepolymer having an ethylenically unsaturated bond to be hardened by an electron beam or an ultraviolet ray, a styrene, a methyl methacrylate, a butyl methacrylate, a polyethylene glycol diacrylate, a propylene glycol dimethacrylate, a pentaerythritol acrylate, a trimethyrol propane diacrylate, a pentaerythritol triacrylate, a hexane diol diacrylate, a reaction product of an epoxy resin and an acrylic acid, a reaction product of a methacrylic acid, a pentaerythritol and an acrylic acid, a condensation product of a maleic acid, diethylene glycol and an acrylic acid or the like can be presented.

The binder resin can be selected among the commonly used synthetic resins as mentioned above in consideration to the wettability and the bonding property with respect to the adhesive.

The addition amount of the foaming agent as the foaming substance or the thermally expansible micro capsule is preferably in a range of 0.5 to 100 parts by mass with respect to 100 parts by mass of the binder resin. In the case it is less than 0.5 part by mass, the cushion property of the insulation layer is so low that the effect of forming the insulation layer cannot be obtained. In the case it is more than 100 parts by mass, the hollow ratio after foaming is so large that the mechanical strength of the insulation layer is deteriorated so as not to be durable to ordinary handling. Moreover, the insulation layer surface loses the smoothness so that the adverse effect is posed to the external appearance of and the printing quality.

The insulation layer is formed by coating and drying a dispersion prepared by adding as needed an additive to the above-mentioned foaming substance and binder resin, dissolved in an appropriate organic solvent or dispersed in an organic solvent or water by a forming means such as a gravure printing method, a screen printing method, and a reverse roll coating method using a gravure block or the like.

The thickness of the entire insulation layer is preferably 10 to 100 μm after foaming. In the case it is 10 μm or less, the cushion property and the insulation property become insufficient, and if it is more than 100 μm, the strength is lowered without improving the effect of the insulation layer.

(Thin Film)

The thin film 5 in the thermal transfer image receiving sheet of the present invention comprising a resin layer containing a foaming agent or a thermally expansible micro capsule formed on one side surface and a receiving layer formed on the other side surface has the role of supporting these layers and as heat is applied at the time of thermal transfer, it is preferable that the thin film 5 has a mechanical strength to the degree not to cause a trouble in handling in the heated state.

As the material of the thin film, for example, films of a polyester, polyacrylate, a polycarbonate, a polyurethane, a polyimide, a polyether imide, a cellulose derivative, a polyethylene, an ethylene.vinyl acetate copolymer, a polypropylene, a polystyrene, an acrylic, a polyvinyl chloride, a polyvinylidene chloride, a polyvinyl alcohol, a polyvinyl butylal, a nylon, a polyester ether ketone, a polysulfone, a polyether sulfone, a tetrafluoro ethylene.perfluoro alkyl vinyl ether, a polyvinyl fluoride, a tetrafluoro ethylene.ethylene, a tetrafluoro ethylene.hexafluoro propylene a polychloro trifluoro ethylene, a polyvinylidene fluoride or the like, can be presented. Moreover, a white opaque film produced by adding a white pigment or a filling agent to these synthetic resins and forming a film can be used as well.

The thickness of the thin film used in the present invention can be set optionally, and it is in general about 2 to 10 μm. In the case the adhesion property between the above-mentioned thin film and a layer provided thereon is poor, it is preferable to apply various kinds of the primer process or the corona electric discharge process to the surface of the thin film.

(Receiving Layer)

The receiving layer 60 to be provided on the above-mentioned thin film receives a dye moved form the thermal transfer sheet at the time of heating and maintains the formed image. It is preferable that the receiving layer in the present invention is formed with an organic solvent soluble resin with the below-mentioned resins dissolved in an organic solvent.

As the resin for forming the receiving layer, for example, a polyolefin resin such as a polypropylene, a halide polymer such as a polyvinyl chloride and a polyvinylidene chloride, a vinyl based resin such as a polyvinyl acetate, an ethylene vinyl acetate copolymer, a vinyl chloride vinyl acetate copolymer, and a polyacrylicester, an acetal resin such as a polyvinyl formal, a polyvinyl butylal, and a polyvinyl acetal, various kinds of saturated and unsaturated polyester resins, a polycarbonate based resin, a cellulose based resin such as a cellulose acetate, a styrene based resin such as a polystyrene, an acrylic.styrene copolymer and an acrylonitrile.styrene copolymer, a urea resin, a melamine resin, a polyamide resin such as a benzoguanamine resin or the like can be presented. These resins may be used optionally by blending as well in a range of being compatible with each other.

Moreover, since the above-mentioned receiving layer resins may be fused with the binder resin of the dye layer for supporting the dye at the time of the thermal transfer for the image formation, it is preferable to inner add in the receiving layer various kinds of the mold releasing agents such as a phosphate, a surfactant, a fluorine based compound, a fluorine based resin, a silicone compound, a silicone oil, and a silicone resin to obtain a good mold release property. In particular, those with a modified silicone oil added and hardened are preferable.

As the mold releasing agent, one kind or two or more kinds can be used. Moreover, the addition amount of the mold releasing agent is preferably 0.5 to 30 parts by mass with respect to 100 parts by mass of the dye receiving layer forming resin. In the case the addition amount range is not satisfied, problems such as fusion of the sublimation type thermal transfer sheet and the dye receiving layer of the thermal transfer image receiving sheet and deterioration of the printing sensitivity can be generated. By adding the mold releasing agent to the dye receiving layer, the mold releasing layer can be formed by breeding out the mole releasing agent to the surface of the dye receiving layer after transfer. Moreover, the mold releasing agent can be coated independently on the dye receiving layer without being added into resin for forming the dye receiving layer.

The dye receiving layer can be formed by coating and drying a dispersion prepared by dissolving the above-mentioned resin added a necessary additive such as a mold releasing agent in an appropriate organic solvent or dispersed the resin in an organic solvent or water by a forming means such as a gravure printing method, a screen printing method, and a reverse roll coating method using a gravure block or the like. At the time of forming the above-mentioned dye receiving layer, for the purpose of improving the whiteness degree of the dye receiving layer so as to further improve the sharpness of the transferred image, a white pigment, a fluorescent brightening agent or the like may be added. Although the dye receiving layer to be formed as mentioned above may have an optional thickness, in general it has a 1 to 50 g/m$^2$ thickness in a dry state.

Moreover, the receiving layer may be provided as well by extrusion coating using the various constituent materials thermally melted and kneaded.

(Manufacture Method for a Thermal Transfer Image Receiving Sheet)

The method for manufacturing a thermal transfer image receiving sheet of the present invention comprising a dye receiving layer provided on a base material sheet via an insulation layer and a thin film can be classified broadly into the below-mentioned four kinds.

The first one is a manufacture method comprising the processes of providing a resin layer containing a foaming agent or a thermally expansible micro capsule on one side of the thin film, contacting an extruded resin with the resin layer so as to foam or expand the resin layer at the time of EC laminating the resin layer side of the thin film and the base material sheet for forming an insulation layer, and forming a receiving layer on the thin film surface side.

The second one is a manufacture method comprising the processes of forming a receiving layer on the thin film, providing a resin layer containing a foaming agent or a thermally expansible micro capsule on the opposite surface of the thin film, and contacting an extruded resin with the resin layer so as to foam or expand the resin layer at the time of EC laminating the resin layer side of the thin film and the base material sheet for forming an insulation layer.

According to the above-mentioned two manufacture methods, the process for forming the receiving layer is executed after the process of EC laminating the resin layer side of the thin film and the base material sheet in the former one, and the receiving layer is formed first on the thin film and thereafter the resin layer containing the foaming agent or the thermally expansible micro capsule is provided on the opposite surface of the above-mentioned thin film, and the process of EC laminating the resin layer side of the thin film and the base material sheet is provided. That is, the above-mentioned two manufacture methods differ in the order of the process of forming the receiving layer.

Moreover, according to the latter manufacture method, since the process of forming the receiving layer on the thin film is executed first, it can be formed easily by coating and drying on the flat thin film by a forming means such as a gravure printing method, a screen printing method, and a reverse roll coating method using a gravure block or the like. On the other hand, according to the former manufacture method, the process of forming the receiving layer is executed after the EC laminating process so that the receiving layer is formed on the thin film of the laminated member with the base material sheet/adhesive layer/insulation layer/thin film formed in this order. Since the slight ruggedness is present on the surface of the thin film due to foaming of the insulation layer, the receiving layer forming method should be executed by a forming means such as a reverse roll coating method using a gravure block with good leveling, and furthermore, attention should be paid so as not to deteriorate the cushion property or the like due to the change of the foamed state of the insulation layer by the pressure applied at the time of the receiving layer formation. However, in the case the receiving layer formation of the former one is executed after the EC laminating process, since the receiving layer is formed in the final embodiment of the thermal transfer image receiving sheet, it is easy that the thickness and the smoothness of the receiving layer is adjusted optionally with respect to the printing sensitivity or the printing quality or the like.

The third one is a manufacture method comprising the processes of providing a resin layer containing a foaming agent or a thermally expansible micro capsule on one side of the thin film, applying a heat treatment to the resin layer by an oven or a heat roller so as to form an insulation layer, EC laminating the insulation layer side of the thin film and the base material sheet, and forming a receiving layer on the thin film surface side.

The fourth one is a manufacture method comprising the processes of forming a receiving layer on the thin film, providing a resin layer containing a foaming agent or a thermally expansible micro capsule on the opposite surface of the thin film, applying a heat treatment to the resin layer by an oven or a heat roller so as to form an insulation layer, and EC laminating the insulation layer side of the thin film and the base material sheet.

In comparing the above-mentioned (first and second) manufacture methods to the above-mentioned (third and fourth) manufacture methods, the heat treatment is not applied to the resin layer before the EC lamination in the (first and second) ones, and the process of applying the heat treatment to the resin layer by an oven or a heat roller is provided before the EC lamination in the (third and fourth) ones.

According to the (third and fourth) manufacture methods, since the heat treatment is applied to the resin layer provided on the thin film before the EC lamination for foaming or expanding the resin layer, and thereafter, the resin layer can further be foamed or expanded by the contact with the extruded resin at the time of the EC lamination of the resin layer side of the thin film and the base material sheet, it is effective for finishing or completing the foaming or expanding phenomenon of the resin layer.

The above-mentioned third and fourth manufacture methods differ in the order of the process of forming the receiving layer as in the case of the above-mentioned first and second ones.

Figure 4:
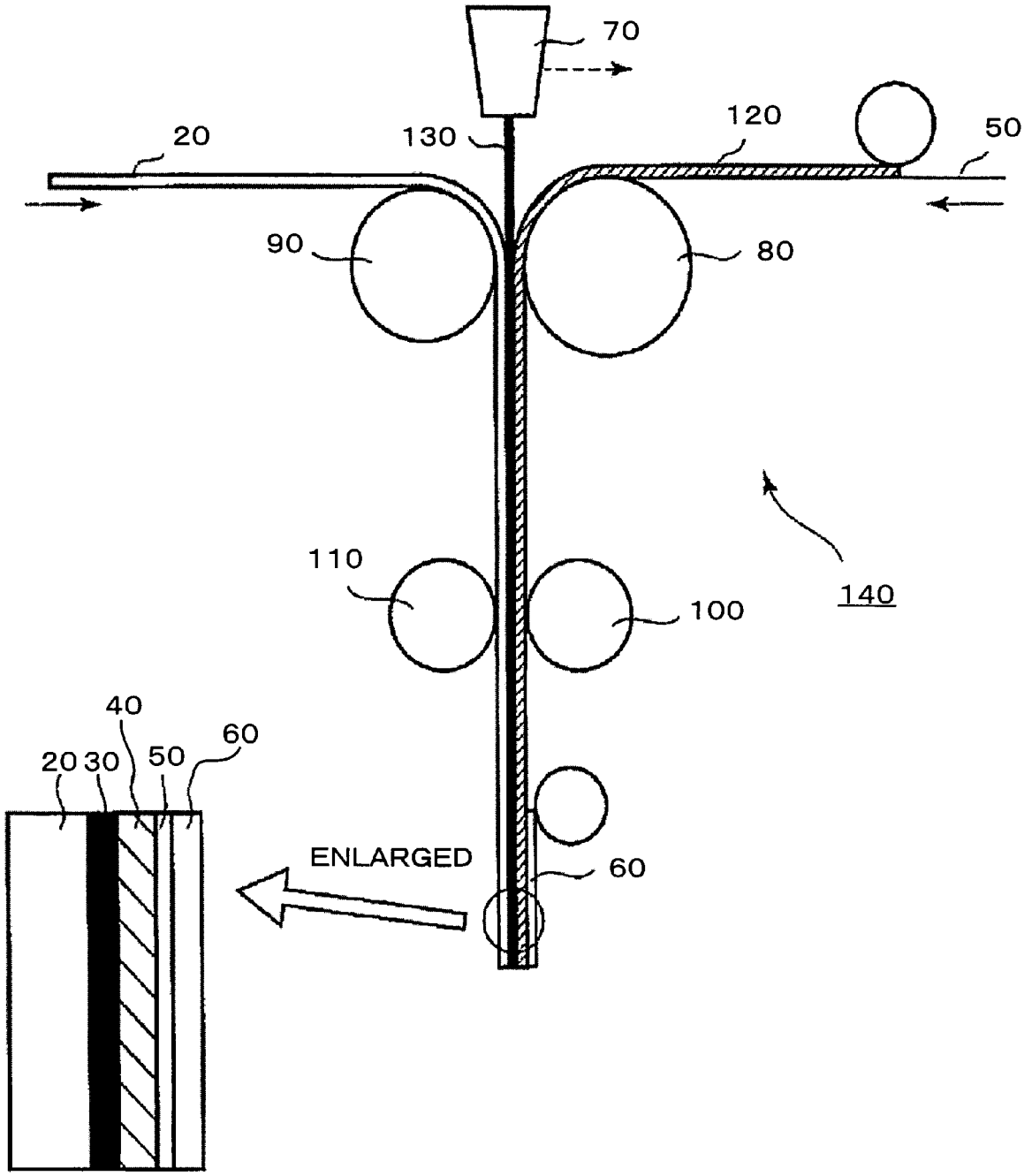
FIG. 4 is a schematic diagram of a manufacture apparatus for explaining a method for manufacturing a thermal transfer image receiving sheet according to the second embodiment of the present invention.

The method for manufacturing thermal transfer image receiving sheet of the present invention is explained using an example of the manufacture apparatus 140 shown in FIG. 4.

First, a resin layer 120 containing a foaming agent or a thermally expansible micro capsule is provided on the thin film 50 by gravure coating or the like. The thin film 50 with the resin layer 120 formed and the base material sheet 20 as the coat paper are EC laminated by extruding a molten resin 130 from a die head 70 to the resin layer 120 side of the thin film 50 and the base material sheet 20 and passing the same between a laminate roll 80 and a press roll 90 so as to be pressured by the rolls.

The position of the die head at the time of the EC lamination is not limited to the center between the laminate roll 80 and the press roll 90, and it can be moved to the thin film side, that is, by moving the same to the laminate roll 80 side (dot line moving direction shown in the figure), the contact time of the molten resin 130 and the resin layer 120 provided on the thin film 50 can be prolonged so as to facilitate foaming or expanding of the resin layer 120.

As the die head, a T die or an inflation die can be used.

It is preferable that the laminate roll 80 on the thin film 50 side is heated at the time of the EC lamination. Thereby, the resin layer 120 can be foamed or expanded further easily. However, as to the heating degree, the roll surface temperature should be at a temperature lower than the melting point of the molten resin 130 supplied form the die head 70.

After the above-mentioned EC laminating process, the laminated member comprising the base material sheet 20/adhesive layer 30/insulation layer 40 (resin layer 120)/thin film 50 passes between the roll 100 and the roll 110 so as to be pressured by the rolls. It is preferable that at least one of the roll 100 and the roll 110 is heated at the time of pressuring. In consideration of the view point of the effectiveness of heating the resin layer 120, in the one roll heating condition, it is preferable to heat the roll 100. The heat treatment by the roll 100 and the roll 110 is effective for finishing or completing the phenomenon of foaming or expanding the resin layer 120. When the phenomenon of foaming or expanding by heating the resin layer containing the foaming agent or the thermally expansible micro capsule is stopped halfway, the potential function of the resin layer cannot be provided sufficiently.

The manufacture of the thermal transfer image receiving sheet is finished by forming the receiving layer 60 on the thin film 50 by a reverse roll coating method using a gravure block or the like after the heat treatment by the heat roll after the above-mentioned EC lamination.

According to the manufacture method shown in FIG. 4, the receiving layer is formed after EC laminating the resin layer side of the thin film and the base material sheet. It is not limited thereto, and it is also possible to first form the receiving layer on the thin film, thereafter provide the resin layer containing a foaming agent or a thermally expansible micro capsule on the opposite surface of the above-mentioned thin film, and EC laminate the resin layer side of the above-mentioned thin film and the base material sheet.

Moreover, according to the manufacture method shown in FIG. 4, a process of applying a heat treatment to the resin layer by an oven or a heat roller can be added before the EC lamination so that the insulation layer can be formed by foaming or expanding the resin layer certainly without stopping halfway the foaming or expanding phenomenon of the resin layer.

Moreover, a further smooth receiving paper can be obtained by executing a calender process after these processes.

EXAMPLES

The present invention will be explained further specifically with reference to an example according to the first embodiment.

Example 1-1

By coating an intermediate layer and a dye receiving layer of the below-mentioned compositions on one side surface of a polyester film (produced by Toray Industries, Inc., product name: LUMIRROR) having a thickness of 6 μm as the base material film each in a dry coating amount of 2.0 g/m$^2$ and 4.0 g/m$^2$ by the gravure coating method, and drying them, the intermediate layer and the dye receiving layer of the theromal transfer image receiving sheet of Example 1-1 was formed.

| (1) Intermediate layer | |
|---|---|
| Polyester resin (VYLON 200, produced by Toyobo Co., Ltd.) | 10 parts by weight |
| Titanium oxide (TCA-888, produced by Tohkem Products Co., Ltd.) | 20 parts by weight |
| Methyl ethyl ketone/toluene = 1/1 | 120 parts by weight |

| (2) Dye receiving layer | |
|---|---|
| Vinyl chloride.vinyl acetate copolymer (Denki Kagaku Kogyo Kabushiki Kaisha, #1000 A) | 100 parts by weight |
| Amino modified silicone (Shin-Etsu Chemical Co., Ltd., X22-3050C) | 5 parts by weight |
| Epoxy modified silicone (Shin-Etsu Chemical Co., Ltd., X22-3000E) | 5 parts by weight |
| Methyl ethyl ketone/toluene = 1/1 | 400 parts by weight |

Moreover, by coating a porous layer of the below-mentioned composition on the other surface of the above-mentioned polyester film by the gravure coating method by 10 μm, and thereafter drying at 110° C. for 1 minute, the porous layer was formed. The content ratio of the hollow particles and the binder resin in the porous layer was hollow particles:binder resin=7:3 by the solid component ratio.

| (3) Porous layer | |
|---|---|
| Acrylic based hollow particles (Rohm and Haas Company, Ropaque HP-1055) | 100 parts by weight |
| Polyvinyl alcohol 15% solution (The Nippon | 76 parts by weight |

-continued

| (3) Porous layer | |
|---|---|
| Synthetic Chemical Industry Co., Ltd., KM-11; average polymerization degree 1,000) | |
| Water | 10 parts by weight |

Furthermore, by preparing a coat paper of a 127 g/m$^2$ basis weight (produced by Mitsubishi Paper Mills Limited, product name: Pearl Coat) as the paper base material, providing an adhesive layer of the below-mentioned composition, and attaching the porous layer of the polyester film with the above-mentioned intermediate layer, dye receiving layer and porous layer formed and the paper base material via an adhesive layer, the thermal transfer image receiving sheet of Example 1-1 was formed.

| (4) Adhesive layer | |
|---|---|
| Urethane resin (Mitsui Takeda Chemicals, Inc., Takelack A-969V) | 30 parts by weight |
| Hardening agent (Mitsui Takeda Chemicals, Inc., Takenate A-5) | 10 parts by weight |
| Ethyl acetate | 120 parts by weight |

Example 1-2

The thermal transfer image receiving sheet of Example 1-2 was formed by attaching the porous layer and the paper base material of Example 1-1 by the EC laminating method with the below-mentioned resin used as the extruded resin.

(5) EC Resin

Low density polyethylene resin (Sumitomo Mitsui Polyolefin Company, Limited, Sumikasen 10P)

Example 1-3

In the same manner as in Example 1-1 except that the thickness of the porous layer was changed to 40 μm, the thermal transfer image receiving sheet of Example 1-3 was formed.

Example 1-4

In the same manner as in Example 1-1 except that the base material film was changed to a polyester film having a thickness of 16 μm, the thermal transfer image receiving sheet of Example 1-4 was formed.

Example 1-5

In the same manner as in Example 1-1 except that the base material film was changed to a polypropylene film having a thickness of 6 μm, the thermal transfer image receiving sheet of Example 1-5 was formed.

Example 1-6

In the same manner as in Example 1-1 except that a resin coat layer having a thickness of 6 μm was provided on the rear surface side of the coat paper as the paper base material of Example 1-1, the thermal transfer image receiving sheet of Example 1-6 was formed.

Comparative Example 1-1

In the same manner as in Example 1-1 except that the base material film was changed to a polyester film having a thickness of 30 μm, the thermal transfer image receiving sheet of Comparative example 1-1 was formed.

Comparative Example 1-2

By forming the porous layer of Example 1-1 by a 40 μm on one side surface of the paper base material of Example 1-1, and coating the intermediate layer and the dye receiving layer of Example 1-1 onto the porous layer each by the coating amount after drying of 4.0 g/m$^2$ and 4.0 g/m$^2$ by the gravure coating method and drying, the thermal transfer image receiving sheet of Comparative example 1-2 was formed.

Comparative Example 1-3

In the same manner as in Comparative example 1-2 except that the composition of the intermediate layer of Comparative example 1-2 was changed to the below-mentioned, the thermal transfer image receiving sheet of Comparative example 1-3 was formed.

| * Intermediate layer | |
|---|---|
| Polyester based urethane (Dainippon Ink and Chemicals, Incorporated, product name: AP-40) | 50 parts by weight |
| Polyvinyl alcohol 15% solution, saponification degree 88% (The Nippon Synthetic Chemical Industry Co., Ltd., GL-05) | 33 parts by weight |
| Water/isopropyl alcohol = 1/1 | 30 parts by weight |

[Evaluation]

Next, the thermal transfer image receiving sheets of the examples and the comparative examples according to the first embodiment were executed as mentioned below.

<Evaluation Method>

(1) Thermal Transfer Recording

The thermal transfer recording was executed using a transfer film UPC-740 for a sublimation transfer printer UP-D70A produced by Sony Corporation as the thermal transfer sheet, and the thermal transfer image receiving sheets of Examples 1-1 to 1-6 and Comparative examples 1-1 to 1-3 each as the thermal transfer image receiving sheet to be used in a combination with the thermal transfer sheet by superimposing the dye layer of the thermal transfer sheet and the dye receiving sheet of the thermal transfer image receiving sheet facing with each other, and heating the thermal transfer sheet from the rear surface side thereof by the thermal head in the order of Y, M, C and the protection layer. The thermal transfer recording conditions were as follows.

(Thermal Transfer Recording Conditions)

A gradation image was formed by the below-mentioned conditions.

Thermal head: KYT-86-12MFW11 (produced by Kyocera Corporation)

Heat generating member average resistance value: 2,994 Ω (ohm)

Main scanning direction printing density: 300 dpi
Sub scanning direction printing density: 300 dpi
Applied voltage: 18.5 V (volt)
1 line cycle: 5 msec
Printing starting temperature: 30° C.
Printing size: 100 mm×150 mm
Gradation print: 16 gradations from Step 1 to Step 16 were controlled with a multi pulse method test printer capable of changing the number of divided pulses, each of which has a pulse length of equally dividing a one line cycle by 256 in a one line cycle, between 0 to 255, by fixing the duty ratio of each divided pulse to 60%, and increasing stepwise each by 17 from 0 to 255 the number of pulses per one line cycle, such as 0 at Step 1, 17 at Step 2, and 34 at Step 3.
Transfer of the protection layer: The protection layer was transferred on the entire surface of the printed matter with the above-mentioned test printer by so-called solid printing with the duty ratio of each divided pulse fixed to 50%, and the number of pulses per one line cycle fixed to 210.

(2) Evaluation of the Printing Density

The maximum reflection density of the printed matter formed as mentioned above was measured by a visual filter using an optical reflection density meter (produced by Macbeth, Macbeth RD-918). Evaluation was executed by giving ○ to cases measuring the reflection density of 1.7 or more, and giving x to cases measuring the one less than 1.7.

(3) Evaluation of the Density Irregularity

By the visual observation of the above-mentioned printed matter, evaluation was executed by giving ○ to cases not having the density irregularity and giving x to cases having the density irregularity.

<Evaluation Result>

The results of the above-mentioned evaluation are as shown in the Table 1. Those having x for either of the printing density and the density irregularity were given x also for the total evaluation. According to the Table 1, Examples 1-1 to 1-5 have ○ in the total evaluation so that the effectiveness of the thermal transfer image receiving sheet of the present invention was confirmed.

TABLE 1

| Specimen | Printing density | Density irregularity | Remark | Total evaluation |
|---|---|---|---|---|
| Example 1 | ○ | ○ | — | ○ |
| Example 2 | ○ | ○ | — | ○ |
| Example 3 | ○ | ○ | — | ○ |
| Example 4 | ○ | ○ | — | ○ |
| Example 5 | ○ | ○ | — | ○ |
| Example 6 | ○ | ○ | — | ○ |
| Comparative example 1 | X | ○ | — | X |
| Comparative example 2 | X | X | Porous layer broken | X |
| Comparative example 3 | ○ | X | — | X |

Next, the present invention will be explained further specifically with reference to the example concerning the second embodiment. "Part" and "%" in the description are based on the mass unless otherwise specified.

Example 2-1

An insulation resin layer (1) of the below-mentioned composition was formed on a PET (polyethylene terephthalate) base member having a thickness of 4 μm as the thin film in a dry coating amount of 15 g/by gravure coating. Then, the resin layer side of the PET base material and a coat paper of 158 g/m$^2$ basis weight as the base material sheet were EC laminated by the T die method by the extruded resin of the below-mentioned composition. The thickness of the adhesive layer of the extruded resin was 10 g/m$^2$ (solid component).

At the time of the above-mentioned EC lamination, the insulation layer was formed by foaming or expanding the resin layer by contacting the extruded resin with the above-mentioned resin layer so as to obtain the insulation sheet.

| (1) Insulation resin layer (1) | |
|---|---|
| Ethylene-.vinyl acetate copolymer resin (EMARCELL, produced by Eiwa Chemical Ind. Co., Ltd.) | 30 parts |
| Foaming agent (EMARCELL BA-1, produced by Eiwa Chemical Ind. Co., Ltd.) | 1 part |
| Water/IPA = 1/1 (mass ratio) | 70 parts |

(2) Extruded Resin

Polyethylene Resin (Sumikasen 10P)

By coating and drying an intermediate layer and a receiving layer of the below-mentioned compositions on the surface of the PET base material side of the above-mentioned insulation sheet by gravure coating in dry amount of 2.0 g/m$^2$ and 4.0 g/m$^2$ respectively, the thermal transfer image receiving sheet (1) was obtained.

| (3) Intermediate layer (surface smooth layer) | |
|---|---|
| Polyester resin (VYLON 200, produced by Toyobo Co., Ltd.) | 10 parts |
| Titanium oxide (TCA-888, produced by Tohkem Products Co., Ltd.) | 20 parts |
| Methyl ethyl ketone/toluene = 1/1 (mass ratio) | 120 parts |
| (4) Receiving layer | |
| Vinyl chloride-.vinyl acetate copolymer (Denki Kagaku Kogyo Kabushiki Kaisya, #1000 A) | 100 parts |
| Amino modified silicone (Shin-Etsu Chemical Co., Ltd., X22-3050C) | 5 parts |
| Epoxy modified silicone (Shin-Etsu Chemical Co., Ltd., X22-3000E) | 5 parts |
| Methyl ethyl ketone/toluene = 1/1 (mass ratio) | 400 parts |

Example 2-2

In the same manner as in Example 2-1 except that the insulation resin layer of the insulation sheet manufactured in Example 2-1 was changed to the insulation resin (2) of the below-mentioned composition, the thermal transfer image receiving sheet (2) was obtained.

| (5) Insulation resin layer (2) | |
|---|---|
| Thermally expansible micro capsule containing resin (NEW DYFORM, produced by Dainichiseika Color & Chemicals Mfg. Co., Ltd.) | 50 parts |
| Ethyl acetate/IPA = 1/2 (mass ratio) | 50 parts |

Example 2-3

In the same manner as in Example 2-1 except that the T die was moved to the PET base member side at the time of the EC lamination of the insulation sheet of Example 2-1, the thermal transfer image receiving sheet (3) was obtained.

Example 2-4

In the same manner as in Example 2-1 except that the laminate roll on the PET base material side was heated to 80° C. at the time of the EC lamination of the insulation sheet of Example 2-1, the thermal transfer image receiving sheet (4) was obtained.

Example 2-5

In the same manner as in Example 2-1 except that the heat treatment by the heat roll (heat roll surface temperature 80° C.) was executed before the receiving layer forming process after the EC lamination in the insulation sheet manufacture process of Example 2-1, the thermal transfer image receiving sheet (5) was obtained.

Comparative Example 2-1

In the same manner as in Example 2-1 except the insulation resin layer was not formed on the PET base material of Example 2-1, the thermal transfer image receiving sheet (6) was obtained.

[Evaluation]

Next, the thermal transfer image receiving sheets of the examples and the comparative examples according to the second embodiment were executed as mentioned below.

<Evaluation Method>

(1) Thermal Transfer Recording

The thermal transfer recording was executed with a transfer film UPC-740 for a sublimation transfer printer UP-D70A produced by Sony Corporation as the thermal transfer sheet, and the thermal transfer image receiving sheets of the examples and comparative example according to the above-mentioned second embodiment by superimposing the dye layer and the dye receiving sheet of the thermal transfer image receiving sheet surface facing with each other, and heating the thermal transfer film from the rear surface side thereof by the thermal head in the order of Y, M, C and the protection layer by the below-mentioned thermal transfer recording conditions.

(1) Printed Characters A

A gradation image was formed by thermal transfer recording under the below-mentioned conditions.

Thermal head: KYT-86-12MFW11 (produced by Kyocera Corporation)

Heat generating member average resistance value: 4,412 (Ω)

Main scanning direction printing density: 300 dpi

Sub scanning direction printing density: 300 dpi

Applied voltage: 0.136 (w/dot)

1 line cycle: 6 (msec)

Printing starting temperature: 30 (° C.)

Printing size: 100 mm×150 mm

Gradation print: 16 gradations from Step 1 to Step 16 were controlled with a multi pulse method test printer capable of changing the number of divided pulses, each having a pulse length of equally dividing a one line cycle by 256, in a one line cycle between 0 to 255, by fixing the duty ratio of each divided pulse to 40%, and increasing successively the number of pulses per line cycle by 17 every gradation from 0 to 255, such as 0 at Step 1, 17 at Step 2, and 34 at Step 3.

Transfer of the protection layer: The protection layer was transferred on the entire surface of the printed matter with the multi pulse method test printer capable of changing the number of divided pulses, each having a pulse length of equally dividing a one line cycle by 256 in a one line cycle between 0 to 255 by so-called solid (18) printing with the duty ratio of each divided pulse fixed to 50%, and the number of pulses per one line cycle fixed to 210.

(3) Printing Density

The maximum reflection density of the above-mentioned printed matter was measured by a visual filter with an optical reflection density meter (produced by Macbeth, Macbeth RD-918).

Evaluation:

○ . . . The maximum reflection density of 1.7 or more x . . . The maximum reflection density of less than 1.7

(2) Printed Matter External Appearance

By the visual observation of the above-mentioned printed matter, judgment was made by the below-mentioned criteria.

Evaluation:

○ . . . No density irregularity x . . . Having the density irregularity

<Evaluation Result>

The results of the above-mentioned evaluation are as shown in the Table 2.

TABLE 2

| Test specimen | Printing density | Printed matter external appearance | Total evaluation |
|---|---|---|---|
| Example 1 | ○ | ○ | ○ |
| Example 2 | ○ | ○ | ○ |
| Example 3 | ○ | ○ | ○ |
| Example 4 | ○ | ○ | ○ |
| Example 5 | ○ | ○ | ○ |
| Comparative example 1 | X | ○ | X |

As heretofore explained, according to the thermal transfer image receiving sheet of the present invention and the method for manufacturing the same, since the dye receiving layer is provided on one surface side of the base material film independently from the paper base material and the porous layer is provided on the other surface side, respectively, the moisture content does not permeate into the base material film at the time of coating the porous layer or even when it permeates therein, the permeation degree is far less than the permeation with respect to the paper base material, so that the dye receiving layer can be formed with a high smoothness by restraining the ruggedness of the base material comprising the porous layer. Moreover, since the porous layer provided on the base material film and the paper base material are attached via the adhesive layer, by attaching the paper base material after drying the coating solution for the porous layer, the smoothness of the dye receiving layer can be maintained at a high level by preventing the appearance of the ruggedness regardless of the kind of the paper base material without the risk of the permeation of the moisture content into the paper base material. Thereby, a high-quality image can be obtained without the density irregularity or the dot omission at the time of the image formation.

Furthermore, the present invention provides the method for manufacturing a thermal transfer image receiving sheet, having a dye receiving layer provided on a base material sheet via an insulation layer and a thin film, comprising the processes of providing a resin layer containing a foaming agent or a thermally expansible micro capsule on one side of the thin film, contacting an extruded resin with the resin layer so as to foam or expand the resin layer at the time of EC laminating the resin layer side of the thin film and the base material sheet for forming an insulation layer, and forming a receiving layer on the thin film surface side. Alternatively, it provides the manufacture method comprising the processes of forming a receiving layer on the thin film, providing a resin layer containing a foaming agent or a thermally expansible micro capsule on the opposite surface of the thin film, and contacting an extruded resin with the resin layer so as to foam or expand the resin layer at the time of EC laminating the resin layer side of the thin film and the base material sheet for forming an insulation layer.

Moreover, the present invention provides a method for manufacturing a thermal transfer image receiving sheet having a dye receiving layer provided on a base material sheet via an insulation layer and a thin film, comprising the processes of providing a resin layer containing a foaming agent or a thermally expansible micro capsule on one side of the thin film, applying a heat treatment to the resin layer by an oven or a heat roller so as to form an insulation layer, EC laminating the insulation layer side of the thin film and the base material sheet, and forming a receiving layer on the thin film surface side. Alternatively, it provides a manufacture method, comprising the processes of forming a receiving layer on the thin film, providing a resin layer containing a foaming agent or a thermally expansible micro capsule on the opposite surface of the thin film, applying a heat treatment to the resin layer by an oven or a heat roller so as to form an insulation layer, and EC laminating the insulation layer side of the thin film and the base material sheet.

Accordingly, by foaming or expanding the resin layer containing a foaming agent or a thermally expansible micro capsule by contacting the same with an extruded resin at the time of EC laminating the resin layer side of the thin film and the base material sheet, or as needed, by applying a heat treatment to the resin layer by an oven or a heat roller before EC laminating, the insulation layer is formed. The insulation layer has a high cushion property and an insulation property. Thereby, a laminated and attached sheet of a foamed film and a core material can be manufactured inexpensively and efficiently so that a high performance thermal transfer image receiving sheet, capable of obtaining an image with a high density and a high resolution can be obtained without the density irregularity or the dot omission.

What is claimed is:

1. A thermal transfer image receiving sheet comprising a dye receiving layer provided on one side surface of a base material film and a porous layer having hollow particles bonded to a binder resin on the other surface side, respectively, the porous layer being bonded with a paper base material via an adhesive layer, wherein the binder resin is a polyvinyl alcohol resin having a 1,000 or more average polymerization degree.

2. The thermal transfer image receiving sheet according to claim 1, wherein the binder resin is water soluble resin.

3. The thermal transfer image receiving sheet according to claim 1, wherein the thickness of the base material film is 20 μm or less.

4. The thermal transfer image receiving sheet according to claim 1, wherein the content ratio of the hollow particles in the porous layer is in a range of 70% by weight to 90% by weight.

5. The thermal transfer image receiving sheet according to claim 1, wherein the thickness of the porous layer is in a range of 5 μm to 40 μm.

6. The thermal transfer image receiving sheet according to claim 1, wherein the adhesive layer is a resin extruded by an extruding machine.

7. A method for manufacturing a thermal transfer image receiving sheet comprising the processes of forming a dye receiving layer on one surface side of a base material film and a porous layer by bonding hollow particles to a binder resin on the other surface side, respectively and attaching the porous layer on a paper base material via an adhesive layer after drying the porous layer, wherein a polyvinyl alcohol resin having a 1,000 or more average polymerization degree is used as the binder resin.

8. The method for manufacturing a thermal transfer image receiving sheet according to claim 7, wherein the porous layer and the paper base material are attached via an extruded resin.

9. The method for manufacturing a thermal transfer image receiving sheet according to claim 7 or 8, wherein a water soluble resin is used as the binder resin.

10. The method for manufacturing a thermal transfer image receiving sheet according to claim 7, wherein the thickness of the base material film is 20 μm or less.

11. The method for manufacturing a thermal transfer image receiving sheet according to claim 7, wherein the content ratio of the hollow particles in the porous layer is in a range of 70% by weight to 90% by weight.

12. The method for manufacturing a thermal transfer image receiving sheet according to claim 7, wherein the thickness of the porous layer is in a range of 5 μm to 40 μm.

* * * * *